United States Patent [19]

Yamagishi

[11] Patent Number: 4,524,915

[45] Date of Patent: Jun. 25, 1985

[54] OPPOSED TYPE JET MILL

[75] Inventor: Takashi Yamagishi, Fujisawa, Japan

[73] Assignee: Turbo Kogyo Co., Ltd., Yokosuka, Japan

[21] Appl. No.: 660,964

[22] Filed: Oct. 15, 1984

Related U.S. Application Data

[63] Continuation of Ser. No. 447,233, Dec. 6, 1982, abandoned.

[30] Foreign Application Priority Data

Feb. 6, 1982 [JP] Japan ..... 57-17893

[51] Int. Cl.[3] ..... B02C 19/06

[52] U.S. Cl. ..... 241/39; 241/5

[58] Field of Search ..... 241/5, 39, 40, 79.1

[56] References Cited

U.S. PATENT DOCUMENTS 3,550,868 12/1970 Stephanoff ..... 241/5
3,675,858 7/1972 Stephanoff ..... 241/39 X
4,019,688 4/1977 Akunov et al. ..... 241/39

FOREIGN PATENT DOCUMENTS 562602 6/1977 U.S.S.R. ..... 241/39

*Primary Examiner*—Mark Rosenbaum

[57] ABSTRACT

An opposed type jet mill, in which a discharge pipe for feeding a mixture flow of high speed gas and ground material discharged from a grinding chamber to an airflow classifying chamber is provided nearly at an equal distance from a new raw material accelerating injector and a regrinding raw material accelerating injector disposed on the left and right hands, respectively, of the grinding chamber and at right angles to a common center line of the both injectors, and a coarse grain return pipe for feeding coarse grains separated in said airflow classifying chamber to the regrinding raw material accelerating injector is disposed so that the angle formed between said return pipe and said regrinding raw material accelerating injector may become an acute angle of 60 degrees or less, which jet mill can reduce energy loss of gas flows and yet can achieve micro-fine grinding.

5 Claims, 3 Drawing Figures

OPPOSED TYPE JET MILL

This is a continuation of application Ser. No. 447,233 filed Dec. 6, 1982, now abandoned.

The present invention relates to an opposed type jet mill, in which injectors for accelerating pulverized raw material by ejecting high pressure gas through a nozzle are mounted on the left and right sides of a grinding chamber so that their respective center lines may align on the same straight line with their outlets opposed to each other to achieve a grinding action, new material to be ground is supplied externally of the machine to one of the injectors, and a coarse component of ground material that has been obtained by making a high speed mixture flow of ground material discharged from the grinding chamber and gas revolve around a straight line perpendicular to a plane passing the aforementioned center line and separating the mixture by the action of a centrifugal force, that is, regrinding material is supplied to the other injector.

In the case where raw material such as medicines, pigment, metal oxide, synthetic resin, etc. having a grain size of several millimeters is accelerated by high pressure gas at 5 to 20 atm. to make it strike against a fixed wall surface or a flow of raw material and thereby produce fine material having a grain size of several microns, such fine material cannot be obtained through grinding of one time, and so grinding must be repeated many times. Accordingly, even in the above-referred opposed type jet mill, the flow rate of regrinding material amounts to several times as large as the feed rate of new material.

Figure 1:
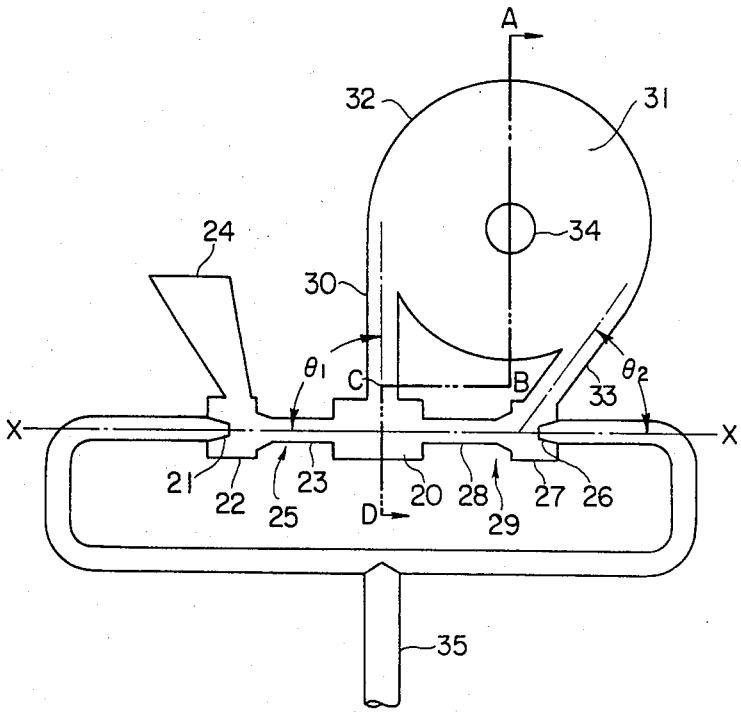

This kind of opposed type jet mill in the prior art such as, for example, that illustrated in FIG. 1 of U.S. Pat. No. 3,229,918 (corresponding to FIG. 11 of Japanese Patent Publication No. 48-42905) has the structure shown in FIG. 3 of the accompanying drawings of this application, in which in order to provide a smooth flow in a flow path extending from an injector 1 for accelerating regrinding raw material, through a grinding chamber 2, a ground material discharge pipe 3 and an airflow classifying chamber 4 to a discharge port 5 for discharging a mixture flow of fine powder and exhaust air, the above-mentioned ground material discharge pipe 3 was disposed so as to rise from the grinding chamber 2 in an obliquely upward direction at an acute angle of 45 to 60 degrees as viewed from the direction of the flow of the injector 1 for accelerating regrinding raw material. Since it is desirable to select the central angle between the inlet of a mixture flow of ground material and gas and the outlet of separated coarse grains in the airflow classifying chamber 4 at a large angle by selecting the angle between a coarse grain return pipe 6 for returning coarse grains separated in the airflow classifying chamber 4 to the regrinding raw material accelerating injector 1 and the above-mentioned ground material discharge pipe 3 at a large angle, the coarse grain return pipe 6 is disposed nearly at right angles to the center line of the regrinding raw material accelerating injector 1.

As described above, in the opposed type jet mill in the prior art, since the structure was such that the ground material discharge pipe 3 makes an acute angle with respect to the center line of an injector 7 for accelerating new raw material, it was necessary to regulate the proportion of the flow rate of the high pressure gas for feeding new raw material to the accelerating injector 7 relative to the flow rate of the high pressure gas fed to the regrinding raw material accelerating injector 1 to an appropriate value within a range of 30 to 60% by making the diameter of the nozzle 8 of the accelerating injector 7 smaller than that of the nozzle 9 of the regrinding raw material accelerating injector 1 and adjusting a choke valve 10, although the optimum proportion is different depending upon various conditions such as the kind, grain size distribution, etc. of the raw material to be ground.

More particularly, if the flow rate of the high pressure gas fed to the new raw material accelerating injector 7 becomes too large and the momentum of the jet flow of new raw material ejected from this injector 7 approaches the momentum of the jet flow of regrinding raw material ejected from the regrinding raw material accelerating injector 1, then ground material bouncing out of the grinding chamber 2 would violently strike against the upper wall of the ground material discharge pipe 3 and would be reflected, resulting in application of large resistance to the outflow of the mixture flow of ground material and gas, and especially, raw materials having a strong adhesive property such as titanium white, chrome yellow, etc. would produce a hard adhesion at this portion, which presents a large resistance. Consequently, ejection of regrinding raw material from the outlet of the regrinding raw material accelerating injector 1 is prevented, hence the raw material begins to block the interior of the suction chamber 11 of this injector 1 and the subsequent coarse grain return pipe 6, and smooth operation would become impossible.

On the contrary, if the flow rate of the high pressure gas fed to the new raw material accelerating injector 7 is insufficient, then the suction effect of this injector 7 is degraded, so that the feed rate of new raw material and hence the production rate of fine powder discharged from the discharge port 5 are lowered. Furthermore, if this flow rate is too small, then there may occur the phenomenon that the jet flow ejected from the regrinding new material accelerating injector 1 advances straightly holding its large momentum and blows out externally of the machine through a new raw material feeding chute 12 of the new raw material accelerating injector 7.

Figure 3:
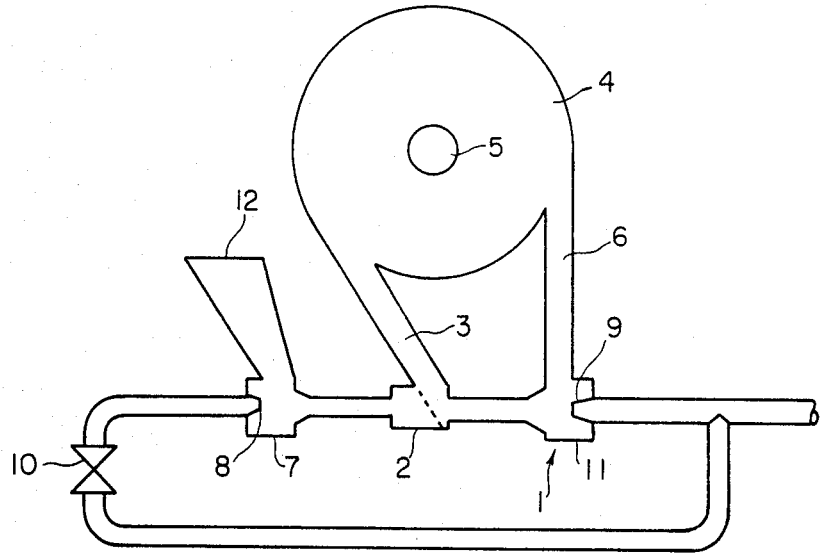
FIG. 3 PRIOR ART

A stable operation can be realized when the surface of the new material fed into the grinding chamber 2 takes the state shown by a dash line depicted within the grinding chamber 2 in FIG. 3, where the regrinding material accelerated by the regrinding material accelerating injector 1 is successively striking against the new raw material to be ground together and they are flowing out through the ground material discharge pipe 3. However, there was a shortcoming that in order to realize such a stable operating state, careful manipulation of the choke valve 10 and precise regulation of a flow rate of new raw material at a new raw material feeding machine outside of the jet mill.

It is therefore one object of the present invention to provide an opposed type jet mill, in which the above-mentioned shortcoming in the prior art can be overcome, a stable operation can be easily established, the stable operation can be continued even if a grain size distribution and/or a feed rate of new raw material should be somewhat varied during a grinding work and a grinding capability has been enhanced.

According to one feature of the present invention, there is provided an opposed type jet mill characterized in that a discharge pipe for feeding a mixture flow of high speed gas discharged from a grinding chamber and ground material to an airflow classifying chamber is disposed substantially at an equal distance from a new raw material accelerating injector and a regrinding raw material accelerating injector provided on the left and right sides, respectively, of a grinding chamber and at right angles to a common center line of the both injectors, and that a coarse grain return pipe for feeding coarse grains separated in the airflow classifying chamber to the regrinding raw material accelerating injector is disposed so that the angle formed between this return pipe and a high pressure gas ejection nozzle of the regrinding raw material accelerating injector may become an acute angle of 60 degrees or less.

According to the present invention, since the ground material discharge pipe is disposed at right angles to the common center line of the new raw material accelerating injector and the regrinding raw material accelerating injector, nearly same magnitudes of momentums are given to the jet flow of the new raw material and the jet flow of the regrinding raw material injected into the grinding chamber from its left and right sides by these injectors to bring them into a head-on collision with each other along the above-mentioned common center line at first, and thereafter these jet flows can be easily made to flow out of the grinding chamber into the ground material discharge pipe. In order to separate fine powder having a grain size of several microns from the ground material to use as a product, a speed of 50 to 100 m/s must be given to this mixture flow, although the valve is varied depending upon the specific gravity of the raw material as well as the radius of curvature of the mixture flow of gas and ground material within the airflow classifying chamber. Accordingly, the coarse grains separated from this mixture flow also have a nearly same magnitude of speed. As noted previously, the regrinding raw material accelerating injector must fully accelerate the regrinding raw material which has a flow rate several times as large as that of the new raw material.

Also, according to the present invention, since the angle formed between the coarse grain return pipe and the high pressure gas ejection nozzle of the regrinding raw material accelerating injector is chosen to be an acute angle of 60 degrees or less and $\cos 60° = \frac{1}{2}$, a component in the direction of acceleration of the regrinding raw material accelerating injector of the momentum possessed by the regrinding raw material incoming at a high speed through the coarse grain return tube, which component has a magnitude more than $\frac{1}{2}$ times as large as the momentum, can be utilized, and also, the large energy loss generated in the case where the high speed jet ejected from the high pressure gas ejection nozzle of this injector is mixed with a large amount of regrinding raw material fed in the direction at right angles to the center line of the injector, can be obviated. Therefore, the regrinding raw material can be sufficiently accelerated with the same amount of energy as the energy possessed by the high pressure gas fed per unit time to the new raw material accelerating injector, and thereby the collision and grinding within the grinding chamber as described above, can be easily realized. Moreover, in the case where the coarse grain return pipe is nearly perpendicular to the center line of the regrinding raw material accelerating injector, when the flow rate of the regrinding raw material fed at a high speed to the injector is large, there would occur the phenomenon that the regrinding raw material strikes against the bottom surface of the suction chamber in the injector, bounces back therefrom and collides with the raw material being subsequently fed, resulting in great interference against the flow of the regrinding material. However, according to the present invention, such phenomena can be perfectly prevented.

According to the present invention, the opposed type jet mill can be easily brought into a stable operating condition, because it is only necessary that while high pressure gas is being fed to the new raw material accelerating injector and the regrinding raw material accelerating injector, the feed amount per unit time of the new raw material from a new raw material feeding machine outside of the jet mill is gradually increased so as to realize the condition that a high frequency tone that is produced when the new raw material and the regrinding raw material injected at a high speed into the grinding chamber collide with each other to be ground, is generated continuously. If the proportion of the feed rate of the new raw material becomes too large, then the continuous high frequency tone disappears and changes to an intermittent tone, and so, at this moment it is only necessary to reduce the proportion of the flow rate of the new raw material. In the case where it is desired to make the ground product further fine, either the proportion of the feed rate of the new raw material is adjusted to the lower limit of the range where a continuous high frequency tone can be generated, or the pressure of the gas fed to the both injectors is raised.

Figure 2:
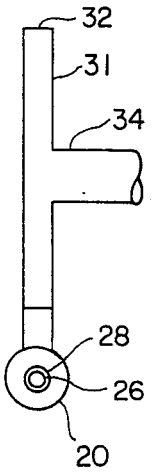

The above-mentioned and other objects, features and advantages of the present invention will be better understood from the following detailed description of preferred embodiments of the invention taken in conjunction with the accompanying drawings, wherein:

FIG. 1 is a vertical cross-section view of an opposed type jet mill according to one preferred embodiment of the present invention in which a new raw material accelerating injector is opposed to a regrinding raw material accelerating injector, FIG. 2 is a cross-section view taken along line A-B-C-D as viewed in the direction of arrows, and FIG. 3 is a vertical cross-section view of an opposed type jet mill in the prior art.

Now one preferred embodiment of the present invention will be described with reference to FIGS. 1 and 2. On one side of a grinding chamber 20 is mounted a new raw material accelerating injector 25 consisting of a nozzle 21 for ejecting high pressure gas, a suction chamber 22 surrounding the nozzle 21, an accelerating pipe 23 having a smaller diameter than the suction chamber 22 and a feed chute 24 for the new raw material, and on the opposite side is mounted a regrinding raw material accelerating injector 29 consisting of a nozzle 26 for ejecting high pressure gas, a suction chamber 27 and an accelerating pipe 28 with the center lines of the respective injectors aligned along the same straight line X—X. A ground material discharge pipe 30 having one end connected to the grinding chamber 20, is tangentially connected at the other end to a cylindrical outer wall 32 of an airflow classifying chamber 31. A coarse grain return pipe 33 having one end tangentially connected to the same outer wall 32 at a separate position, is connected at the other end to the suction chamber 27 of the regrinding raw material accelerating injector 29. In one of disc-shaped end walls of the airflow classifying chamber 31 is provided a discharge port 34. The nozzle 21 of the new raw material accelerating injector 25 and the nozzle 26 of the regrinding raw material accelerating injector 29 are connected to a high pressure gas feed pipe 35.

Representing the angle formed between the ground material discharge pipe 30 and the accelerating pipe 23 of the new material accelerating injector 25 by $\theta_1$ and the angle formed between the coarse grain return pipe 33 and the nozzle 26 of the regrinding raw material accelerating injector 29 by $\theta_2$, then according to the present invention, limitations of $\theta_1=90°$ and $\theta_2<30°$ are imposed upon these angles.

New raw material fed to the feed chute 24 at a constant flow rate from a raw material feeding machine outside of the opposed type jet mill, first enters the suction chamber 22 of the new raw material accelerating injector 25, then it is accelerated in the accelerating pipe 23 by the jet ejected from the nozzle 21 and is injected at a high speed into the grinding chamber 20 jointly with gas, on the other hand regrinding raw material fed into the suction chamber 27 of the regrinding raw material accelerating injector 29 through the coarse grain return pipe 33 is accelerated in the accelerating pipe 28 by the jet ejected from the nozzle 26 and is injected at a high speed into the grinding chamber 20 jointly with gas, the both raw materials collide with each other on a straight line within the grinding chamber 20, solid raw material grains are ground and fly about to the environment, and then they flow out to the ground material discharge pipe 30 jointly with gas. This mixture flow of gas and ground material enters into the airflow classifying chamber 31 through the ground material discharge pipe 30, then revolves along the inside of the outer wall 32, and finely ground material is passed through the discharge port 34 into a powder collector such as a bag filter outside of the jet mill as conveyed by the aforementioned gas, where the finely ground material is collected as separated from the gas. Coarse grains separated by the action of a centrifugal force are passed from the airflow classifying chamber 31 into the coarse grain return pipe 33, and then fed to the above-mentioned regrinding raw material accelerating injector 29.

It is to be noted that upon practicing the present invention, the airflow classifying chamber 31, ground material discharge pipe 30 and coarse grain return pipe 33 could be disposed on the both sides of the grinding chamber 20 and regrinding raw material accelerating injector 29, and that the airflow classifying chamber 31 could have a guide plate equipped therein and it could be modified into a horseshoe shape or the like with a discharge port mounted on its inside instead of the cylindrical shape.

What is claimed is:

1. An opposed type jet mill comprising:

a pair of opposed injectors each having a nozzle for ejecting high pressure gas, said nozzles being aligned on a common axis in opposed relationship to each other;

a grinding chamber between said opposed injectors;

feed means for feeding new raw material solely to one of said injectors;

grinding chamber discharge pipe means connected and oriented generally perpendicularly to said common axis of said nozzles for receiving a high speed flow of a mixture of ground material and gas from the grinding chamber;

an airflow classifying chamber connected to said grinding chamber discharge pipe means for receiving said mixture and separating coarse grains in the ground material;

recycle pipe means connected to said classifying chamber means for returning said coarse grains solely to the other of said injectors for regrinding, said recycle pipe communicating with said other injector at an angle of 60 degrees or less with said common axis of said nozzles and in the direction of said other injector, whereby proper adjustment of the feed rate of new raw material into said one injector causes said mill to create a continuous high frequency tone.

2. An opposed type jet mill as claimed in claim 1 wherein each of said injectors further includes a suction chamber surrounding the nozzle of the injector and an accelerating pipe contiguous to said suction chamber and having a smaller diameter than said suction chamber, said accelerating pipe being aligned coaxially with said nozzle and connected to said grinding chamber.

3. An opposed type jet mill as claimed in claim 1 wherein said airflow classifying chamber is formed of a cylindrical body having relatively short cylindrical sides and flat ends, said cylindrical body being disposed such that its flat ends are parallel to a plane including said common axis of said nozzles.

4. An opposed type jet mill as claimed in claim 1 wherein said nozzles are connected to a single high pressure gas feed pipe.

5. An opposed type jet mill as claimed in claim 3 wherein the velocity of the mixture of ground material and gas revolving within said classifying chamber means is 50 to 100 m/sec.

* * * * *